United States Patent [19]

Tisza

[11] 4,031,046

[45] * June 21, 1977

[54] EXOTHERMIC LINING FOR METALLURGICAL PURPOSES AND METHOD OF MAKING THE SAME

[75] Inventor: Julianna Tisza, Zurich, Switzerland

[73] Assignee: Firma TIDO Chemisch-technische Produkte GmbH, Vienna, Austria

[ * ] Notice: The portion of the term of this patent subsequent to Apr. 15, 1992, has been disclaimed.

[22] Filed: Mar. 31, 1975

[21] Appl. No.: 563,586

[30] Foreign Application Priority Data

Apr. 2, 1974 Austria ..... 2723/74

[52] U.S. Cl. ..... 260/17.2; 106/38.2; 106/38.22; 106/38.23; 106/38.27; 260/38; 264/219; 264/259; 264/267

[51] Int. Cl.[2] ..... C08L 1/02; C08L 3/02

[58] Field of Search ..... 260/17.2, 38; 264/267

[56] References Cited

UNITED STATES PATENTS

| | | | |
|---|---|---|---|
| 3,123,878 | 3/1964 | Davidson | 106/38.2 |
| 3,326,273 | 6/1967 | Jago et al. | 164/349 |
| 3,567,667 | 3/1971 | Rumbold | 260/17.2 |
| 3,660,135 | 5/1972 | Nouveau | 106/38.23 |
| 3,728,102 | 4/1973 | Buckingham | 106/38.2 |
| 3,759,724 | 9/1973 | Nishi et al. | 106/38.22 |
| 3,878,142 | 4/1975 | Tisza | 260/17.2 |

*Primary Examiner*—Edward M. Woodberry
*Attorney, Agent, or Firm*—Ernest F. Marmorek

[57] ABSTRACT

An exothermic lining material for metallurgical purposes comprises 40–60% of aluminium dross, 1–12% of fibrous filler which may be inorganic or a mixture of inorganic and organic materials, 3–6% of binder, such as a phenoplast and up to 1% of wetting agent. In order to make the lining exothermic it contains 7–25% aluminium powder and/or aluminium swarf, 3–15% iron oxide and/or manganese dioxide and not exceeding 6% cryolite. The lining may be made by a dry process in which flakes or pellets of the composition are pressed to a desired shape or by a wet process in which the aluminium dross is added to an aqueous preparation of the fibrous filler and wetting agent, whereafter the other components are added.

21 Claims, No Drawings

EXOTHERMIC LINING FOR METALLURGICAL PURPOSES AND METHOD OF MAKING THE SAME

SUMMARY OF THE INVENTION

This invention relates to a material for making plates or moulded members for use in metallurgical processes as exothermic plates or members and to a method of making the plates or moulded members which will hereinafter be referred to as "exothermic linings".

Various exothermic compositions have been proposed for use in metal foundries as heat-generating materials in the form of plates, or moulded members in the shape of panels, cores or flexible parts or in the form of a loose powder mixture. Moreover, for the production of exothermically reacting anti-pipiing compositions, it has been proposed to incorporate limited quantities of aluminium dross, the composition hardening when it heats up. Desirable as a self-hardening exothermic composition may be, which is prepared exclusively with water and moulded as may be required, it must be borne in mind that the accompanying considerable rise in temperature has undesirable effects on a binder forming part of the composition, resulting in a hardening process which is difficult to control and makes for less convenient handling and processibility.

It has now been found that these defects can be avoided and an exothermic lining material obtained, which is better from the point of view of hardening, temperature control and general convenience of handling, if the dross component is combined with a minor proportion of fibrous fillers, a wetting agent, as well as a synthetic-plastics-based binder and a selected exothermic mixture.

Accordingly, one aspect of the present invention provides a material for making an exothermic lining, comprising, by weight,

| | |
|---|---|
| 40 to 60 % | aluminium dross, |
| 1 to 12 % | fibrous filler, |
| 3 to 6 % | binder, |
| not exceeding 1 % | wetting agent, |
| 7 to 25 % | aluminium powder and/or aluminium swarf or chips, |
| 3 to 15 % | iron oxide and/or manganese dioxide, |
| not exceeding 6 % | and cryolite. |

A lining material of the specified composition permits panels and mouldings of diverse geometries, as well as mouldings prepared by ramming the composition and shaping it in situ to be produced, the self-hardening process generating heat at a rate which is not excessive and the resultant linings possessing fully adequate strength as well as satisfactory flexibility. When the present lining material is employed for its intended purposes, for instance for casting hoods, chill mould covers, cores, risers, feedheads and so forth, the synthetic resin binder as well as the exothermic mixture take effect in a desirably controlled manner. The lining material can be easily obtained and incidentally is characterised by having a low specific gravity.

The aluminium dross which is the principal component is the frozen crust, also known as "dry dross", obtained in the electrolytic production and remelting of aluminium or aluminium alloys. It is assumed that the effect of the combination of aluminium dross with a fibrous filler in the presence of a wetting agent derives from a kind of protective effect of the composition on the otherwise violent reaction between the dross and water.

The fibrous filler is preferably of an inorganic nature, such as asbestos, preferably in the form of amosite, glass fibre, mineral wool, or the like, asbestos fibres being particularly preferred. The lining may also contain an additional organic fibre material which may be, for instance, wood meal, rice straw, or some other cellulose fibre, plastics fibre, or a fibre of a refractory kind.

In one embodiment of the invention, the two kinds of fibre may be included in equal proportions, the lining material preferably containing 3 to 6% by weight of asbestos fibres and 3 to 6% by weight of wood meal. The presence of the wood meal facilitates the escape of gases.

Suitable wetting agents for use in the present material are substances which are also used in the detergent producing industry, naturally always provided they are compatible with the other constituents of the lining material and that they do not impair their effectiveness. Appropriate substances are anionic wetting agents, such as alkylbenzene sulphonates, alkyl sulphates and sulphonates and sulphated fatty acid esters, or non-ionic wetting agents, such as alkoxylated fatty acid condensation products and the like; mixtures of both types of wetting agents may also be used. Conveniently the wetting agents should be introduced in the form of liquid concentrates when the lining material is prepared. The wetting agent is preferably added in a quantity of from 0.01 to 1%, more preferably 0.1 to 0.5% by weight related to the finished material.

The binder used in the lining material is preferably a phenolformaldehyde resin. However, other phenoplasts or aminoplasts could naturally also be used, as well as substances known for such purposes, for example petroleum pitch, dextrin, tar products, sulphite waste liquor, and the like.

The exothermic mixture which is a constituent of the lining material may, as stated, substantially consist of a composition based on mixture of aluminium and iron oxide or similar products comprising for instance an oxidisable metal and an oxygen-supplying compound (such as manganese dioxide or an alkali metal nitrate or chlorate). In combination with the other constituents of the lining material, the exothermic reaction which is as such rather violent is damped and the risk of causing an explosion is thus eliminated. If desired, the present heat-generating lining material may be modified by the addition of conventional components which change the properties of the material in the direction of making it highly refractory, such as clay, for example fireclay or bentonite, sand, dolomite or kieselguhr. Similarly a reduction in specific gravity can be achieved and relatively low density lining materials produced by adding lightweight fillers, such as expanded clay, expanded corundum, expanded vermiculite, pearlite, lightweight fireclay, and like cellular materials.

The solid constituents of the lining material should be generally introduced in finely divided form. For achieving as uniform an effect as possible it is advisable for the solid non-fibrous constituents, except the aluminium component, i.e. the aluminium dross, namely the binder, iron oxide or pyrolusite and the cryolite which may be present to have a grain size from very fine (2 microns or more) to 2.5 mm, not more than half the grain exceeding 1 mm. in size.

For the aluminium component, a particular grain size will normally be chosen, especially as this permits the exothermic reaction to be better controlled with respect to ignition time, temperature and combustion rate. It appears to be advantageous for the aluminium component to be an aluminium powder of a grain size up to 2 mm. and aluminium chips up to 5 mm. in length.

Useful results are also achieved if the aluminium component consists exclusively of a spherical aluminium powder coated with an oxide skin, the grain size being up to 2 mm. though preferably not exceeding 1 mm. The spherical aluminium powder provides a particularly useful degree of stability when the components are mixed to the finished product and when the latter is used.

According to another aspect of the present invention there is provided a method of making an exothermic lining from the material indicated above, wherein the fibrous filler is mixed with the wetting agent, and water to form an aqueous preparation, and aluminium dross in finely divided form as well as the components of the exothermic mixture (aluminium powder and/or swarf and iron oxide and/or manganese dioxide) are introduced into the aqueous preparation, the binder or components reactive to form the binder being then added, whereafter the resulting mixture is treated to render it suitable for forming into the desired shape of the lining, and wherein the lining is formed and then dried to harden it.

In this method the finely divided dross may first be mixed into the aqueous mixture and the premixed components of the exothermic mixture thereafter introduced. However, in a particularly advantageous procedure part or the whole of the aluminium dross may be introduced, in the form of a preliminary mixture with the components of the exothermic mixture, into the aqueous mixture of the fibre material and the wetting agent. This latter procedure leads to a final product of even better homogeneity and to a more uniform course of the reaction when the finished product is used.

If desired the binder or its components could already be incorporated in the exothermic mixture or in its premixture with the aluminium dross.

When the mixture which contains all its specified constituents is further processed it is preferred to prepare a dough-like mass, if necessary by the addition of more water, and then to shape this dough-like mass on a porous or screen-like surface by subjecting it to suction or squeezing until mouldings of sufficient green strength to be handled result.

A modification of this procedure is a nearly dry process which consists in working the mixture of all the constituents in a dry process to form dry flakes or pellets of say 3 mm. diameter which are then directly pressed into mouldings of the desired shape.

Final drying of the mouldings irrespectively of their manner of production is then conveniently done in an oven at a temperature of about 145° to 280° C, according to the nature of the binder used, and until the binder has set.

DETAILED DESCRIPTION OF PREFERRED EMBODIMENTS

The invention will now be illustrated by the following nonlimiting Examples.

EXAMPLE 1

For the production of an exothermic lining material the following composition is prepared:

| | |
|---|---|
| 54 % | Aluminium dross, |
| 4 % | Asbestos fibre, |
| 5 % | Wood meal, |
| 4 % | Phenolformaldehyde resin, |
| 1 % | Wetting agent (Alkylbenzenesulphonate/ethoxylated fatty acid condensate mixture, about 20%), |
| 15 % | Aluminium powder, |
| 12 % | Iron oxide, |
| 5 % | Cryolite. |

The asbestos fibres are intimately mixed with at least a like quantity by weight of water and the wetting agent and a little extra water is added to produce a thin liquid pourable mass. A finely ground aluminium dross is added and the mixture stirred until a uniform slurry is obtained. The constituents of the exothermic mixture (iron oxide and aluminium powder) as well as the cryolite are then incorporated in the slurry. After the addition of the phenolformaldehyde resin, the resultant mass is compressed on a screen connected to a vacuum source, until a plate-like cake is formed. After this has been dried for 2 hours at 250° C a hardened panel about 25 mm. thick which is ready for use is obtained. This is suitable for forming an exothermic lining in a mould for casting fine steels.

EXAMPLE 2

For the production of a lining material capable of generating a large quantity of heat at a rapid rate the following composition is used:

| | |
|---|---|
| 49 % | Aluminium dross, |
| 4 % | Asbestos fibre, |
| 5 % | Wood meal, |
| 4 % | Phenolformaldehyde resin, |
| 1 % | Wetting agent as in Example 1, |
| 10 % | Aluminium powder, |
| 10 % | Aluminium chips, |
| 12 % | Iron oxide, |
| 5 % | Cryolite. |

The production of a panel or of some other moulding proceeds as described in Example 1.

What is claimed is:

1. A material for making an exothermic lining, comprising, by weight,

| | |
|---|---|
| 40 to 60% | aluminum dross, |
| 1 to 12% | fibrous filler, |
| 3 to 6% | binder, |
| 0.01 to 1% | wetting agent selected from the group consisting of anion-active compounds, non-ionic compounds, and mixtures thereof, |
| 7 to 25% | aluminum powder and/or aluminum chips, |
| 3 to 15% | iron oxide and/or manganese dioxide, and |
| not exceeding 6% | cryolite. |

2. The material of claim 1, wherein the fibrous filler is an inorganic filler selected from the group consisting of asbestos, glass fibre and mineral wool.

3. The material of claim 2, wherein the asbestos is amosite.

4. The material of claim 2, wherein the fibrous filler additionally comprises an organic fibrous filler selected from the group consisting of wood meal, rice straw, cellulosic fibres and synthetic fibres.

5. The material of claim 4, wherein the material contains 3 to 6% by weight of asbestos fibres and 3 to 6% by weight of wood meal.

6. The material of claim 1, wherein the wetting agent is an anionic wetting agent.

7. The material of claim 6, wherein the anionic wetting agent is selected from the group consisting of alkylbenzene sulphonates, alkyl sulphates, alkyl sulphonates and sulphated fatty acid esters.

8. The material of claim 1, wherein the wetting agent is a non-ionic wetting agent.

9. The material of claim 8, wherein the wetting agent is an alkoxylated fatty acid condensation product.

10. The material of claim 1, wherein the wetting agent component is a mixture of an anionic wetting agent and a non-ionic wetting agent.

11. The material of claim 1 wherein the solid non-fibrous constituents of the material, except the aluminium component, have a grain size from ultrafine (2 microns) up to 2.5 mm., not more than half the grains exceeding 1 mm. in size.

12. The material of claim 1, wherein the aluminium component consists of an aluminium powder of a grain size up to 2 mm. and aluminium chips up to 5 mm. in length.

13. The material of claim 1, wherein the aluminium component consists exclusively of a spherical aluminium powder coated with an oxide skin, and having a grain size up to 2 mm.

14. The material of claim 1, wherein the binder is a phenolformaldehyde resin.

15. In a method of preparing a material for making an exothermic lining, comprising, by weight,

| | |
|---|---|
| 40 to 60% | aluminum dross, |
| 1 to 12% | fibrous filler, |
| 3 to 6% | binder, |
| 0.01 to 1% | wetting agent selected from the group consisting of anion-active compounds, non-ionic compounds, and mixtures thereof, |
| 7 to 25% | aluminum powder and/or aluminum chips, |
| 3 to 15% | iron oxide and/or manganese dioxide, and |
| not exceeding 6% | cryolite; |

the method steps of providing an aqueous preparation of the fibrous filler and wetting agent, adding the aluminum dross, the aluminum powder and/or chips, the iron oxide and/or manganese dioxide and the cryolite, adding the binder or components reactive to form the binder, treating the resulting mixture to render it suitable for forming into the desired shape of the lining, forming the lining and drying the formed lining to harden it.

16. The method of claim 15, wherein at least part of the aluminium dross is mixed with the other components before being introduced into the aqueous preparation.

17. The method of claim 15, wherein the resulting mixture is worked to a dough-like mass which is moulded on a porous or screen-like surface by squeezing or suction to form mouldings of adequate green strength for handling.

18. The method of claim 15, wherein the lining is dried at a temperature of 145° to 280° C, depending upon the nature of the binder, until the latter has set.

19. The method of claim 15, wherein the wetting agent is incorporated in the aqueous mixture in a quantity of 0.01 to 1% by weight, related to the finished product.

20. The method of claim 19, wherein the quantity of wetting agent is 0.1 to 0.5% by weight.

21. In a method of preparing a material for making an exothermic lining, comprising, by weight the components,

| | |
|---|---|
| 40 to 60% | aluminum dross, |
| 1 to 12% | fibrous filler, |
| 3 to 6% | binder, |
| 0.01 to 1% | wetting agent selected from the group consisting of anion-active compounds, non-ionic compounds, and mixtures thereof, |
| 7 to 25% | aluminum powder and/or aluminum chips, |
| 3 to 15% | iron oxide and/or manganese dioxide, and |
| not exceeding 6% | cryolite; |

the method steps of preparing dry flakes or pellets of a mixture of the components, and directly pressing said flakes or pellets to form the lining.

* * * * *